United States Patent [19]

Shanahan et al.

[11] Patent Number: 4,850,614

[45] Date of Patent: Jul. 25, 1989

[54] TRUCK DRIVER'S RECORDING SYSTEM AND APPARATUS

[76] Inventors: Mary B. Shanahan, P.O. Box 9102, Missoula, Mont. 59807; Anna M. Fendler, 951 Ronald #411, Missoula, Mont. 59801

[21] Appl. No.: 193

[22] Filed: Jan. 2, 1987

[51] Int. Cl.[4] ..... B41L 1/20; B41L 47/56; B41L 3/00; B42D 15/00

[52] U.S. Cl. ..... 282/3 A; 282/9 A; 282/9 R; 283/58

[58] Field of Search ..... 282/3 A, 3 B, 1 R, 9 A, 282/9 R, 8 A, 8 R; 283/66 A, 66 R, 60 R, 58, 56; 229/92.3

[56] References Cited

U.S. PATENT DOCUMENTS

| | | | |
|---|---|---|---|
| 853,050 | 5/1907 | Zelley | 282/9 R |
| 869,054 | 10/1907 | Brown | 282/9 R |
| 1,392,748 | 10/1921 | Davidson | 282/9 A |
| 1,558,898 | 10/1925 | Ledine | 283/56 |
| 1,612,240 | 12/1926 | Uptegraff | 283/56 |
| 1,747,659 | 2/1930 | Bottle | 282/9 A |
| 2,120,160 | 6/1938 | Stevens | 282/9 A |
| 2,370,377 | 2/1945 | Stone | 282/9 R |
| 2,546,584 | 3/1951 | Brock, Jr. | 282/9 R |
| 4,407,524 | 10/1983 | Trautlein | 282/9 R |
| 4,722,553 | 2/1958 | Evans | 283/58 |

FOREIGN PATENT DOCUMENTS

| | | | |
|---|---|---|---|
| 8098 | 1/1908 | France | 282/9 A |

*Primary Examiner*—Frank T. Yost
*Assistant Examiner*—Paul M. Heyrana, Sr
*Attorney, Agent, or Firm*—William D. West

[57] ABSTRACT

A truck driver's recording system and apparatus for recording the duty status, expenses, and daily vehicle inspection report is disclosed. The apparatus provides a plurality of preprinted carbonless sheets arranged in sets for recording the applicable information. The sets are arranged and prescored for separation. An inner cover is provided to eliminate an impression from being transferred to subsequent sheets, and an outer cover is provided for protection of the recording apparatus. A stiffening board is provided to prevent damage to the apparatus. A method of providing advertising space upon a truck driver's recording system and apparatus is also disclosed.

8 Claims, 3 Drawing Sheets

TRUCK DRIVER'S RECORDING SYSTEM AND APPARATUS

BACKGROUND OF THE INVENTION

1. Field of the invention

The invention relates to a Truck Driver's Recording System and Apparatus, and in particular to a recording system booklet having multiple separable recordable sheets, a wrap-around cover, heavy board backing for rigidity, and advertising space on both sides of the cover, and on inner sheets.

2. Discussion of the Technical Problems

Professional truck drivers are required by the U.S. Department of Transportation and the Federal Highway Administration under the provisions of the Federal Motor Carrier Safety Regulations Parts 390 to 399 to maintain a written record of their duty status and vehicle inspections. The required record for each day of duty must include a complete 24-hour log including time spent off-duty and the activity at the time such as sleeping or driving. The driver's required daily vehicle inspection must indicate that certain vehicle components including brakes, horns, lights, steering, and so on have been inspected daily for defects.

Many drivers have an additional need to record their expenses for tax purposes and/or for reimbursement by their employers. The personal expense records include the cost of meals, the cost of fuel and other maintenance expenses, the cost of telephone calls, lodging, and any other miscellaneous expenses.

Since the driver is required to provide a daily log of his hours as well as the daily inspection for defects, a number of prior art log books have been developed which provide for space to record the required information. Usually those log books are soft-bound sheets which contain a place to record the duty status for every 24 hours as well as space to record the daily vehicle inspection. In order to provide necessary copies, the prior art log books utilize carbon paper inserted between multiple printed pages so that a single impression would create one or more copies.

Although the driver is only required to keep a record of daily duty status as well as a daily vehicle inspection report, it would be highly convenient to also keep a record of personal expenses of the driver in the same location as the required records. The driver can, by filling out a complete form every day, insure that he has complied with the regulations of the Department of Transportation as well as provide a contemporaneous recording of expenses for the reporting of income tax and/or for reimbursement from his employer. It would also be convenient if the Driver's Record of Duty Status and the Driver's Daily Vehicle Inspection Report could be separated from the Driver's Personal Expenses by simply separating those reports after they have been recorded. Further to enhance the convenience of the recording requirements of the professional truck driver, such a recording system should include a means by which at least two copies can be made from a single impression made by the driver for each day.

While the above conveniences should be provided in a system for recording the necessary information of professional truck drivers while they are engaged in their occupation, it would also be convenient that such a recording system could be provided to a driver at no cost. In order to provide such a no-cost recording system, the apparatus used for recording should be provided with space for advertising. Advertising space should be in a convenient yet readily noticeable position on the apparatus. If such advertising space were made available, then the cost of producing and distributing the truck driver's recording system could be borne by the advertisers and not the drivers.

No known examples of recording systems or apparatus for professional truck drivers to record their duty status and daily vehicle inspection report in a convenient, multiple-page recording along with space for recording the driver's expenses have been discovered. Furthermore, no system is known that provides such a driver's log with space for advertising so that the system is provided to drivers free of charge.

Accordingly, a need exists for a Truck Driver's Recording System and Apparatus that would provide a convenient multiple-copy, easy-to-separate record of duty status, daily vehicle inspection report, and driver's personal expenses. Furthermore, a need exists for such an apparatus having space for advertising so that the recording system can be distributed free of charge to the professional driver. The instant invention is directed to all of these needs as well as to others as explained in the following summary.

SUMMARY OF THE INVENTION

It is a feature of the instant invention to provide a truck driver's recording system and apparatus.

It is another feature of the instant invention to provide a truck driver's recording system having an apparatus providing multiple copies of the driver's expenses, the driver's record of duty status, and the driver's daily vehicle inspection report.

It is another feature of the instant invention to provide a truck driver's recording system having an apparatus providing multiple copies of the driver's expenses, the driver's record of duty status, and the driver's daily vehicle inspection report which record of driver's expenses, driver's record of duty status, and daily inspection report can be separated without further equipment.

It is another feature of the instant invention to provide a truck driver's recording system and apparatus having advertising space available on multiple pages attached to the apparatus.

These and other features and objects are attained according to the instant invention by providing a driver's recording system and apparatus having a series of printed log pages made of carbonless paper in multiple sets of three. The system utilizes 31 sets of three carbonless paper log pages per booklet. The booklet can be used by a driver for a month by having such a set of 31 in each booklet. The apparatus further includes a cover sheet having space available on front and back for advertising as well as multiple sheets of paper prior to the log pages, which sheets can also be utilized for advertising space. An inner wrap-around cover is printed so that the driver can place the inner cover between each set of log pages as needed to prevent the driver from writing through to subsequent log pages. The wrap-around cover is also provided with space for advertising. The advertising space in the driver's record recording system and apparatus allows the driver to be provided the recording system and apparatus free of charge. The log pages are further provided with easily tearable separations on each page to separate the driver's expenses from the driver's record of duty status and the driver's daily vehicle inspection report. The driver's daily vehicle inspection report is further separable from the driver's record of duty status by being pre-scored on each of the log pages. The perforation is provided between the driver's expenses section, the driver's record of duty status section, and the driver's daily vehicle inspection report. A rigid board backing is provided between the wrap-around cover and the lowestmost log page in order to insure that the driver's record is not damaged.

BRIEF DESCRIPTION OF THE DRAWINGS

The advantages of this invention will become apparent upon consideration of the following detailed disclosure of the invention, especially when taken in conjunction with the accompanying drawings, wherein.

DESCRIPTION OF THE PREFERRED EMBODIMENT

Figure 1:
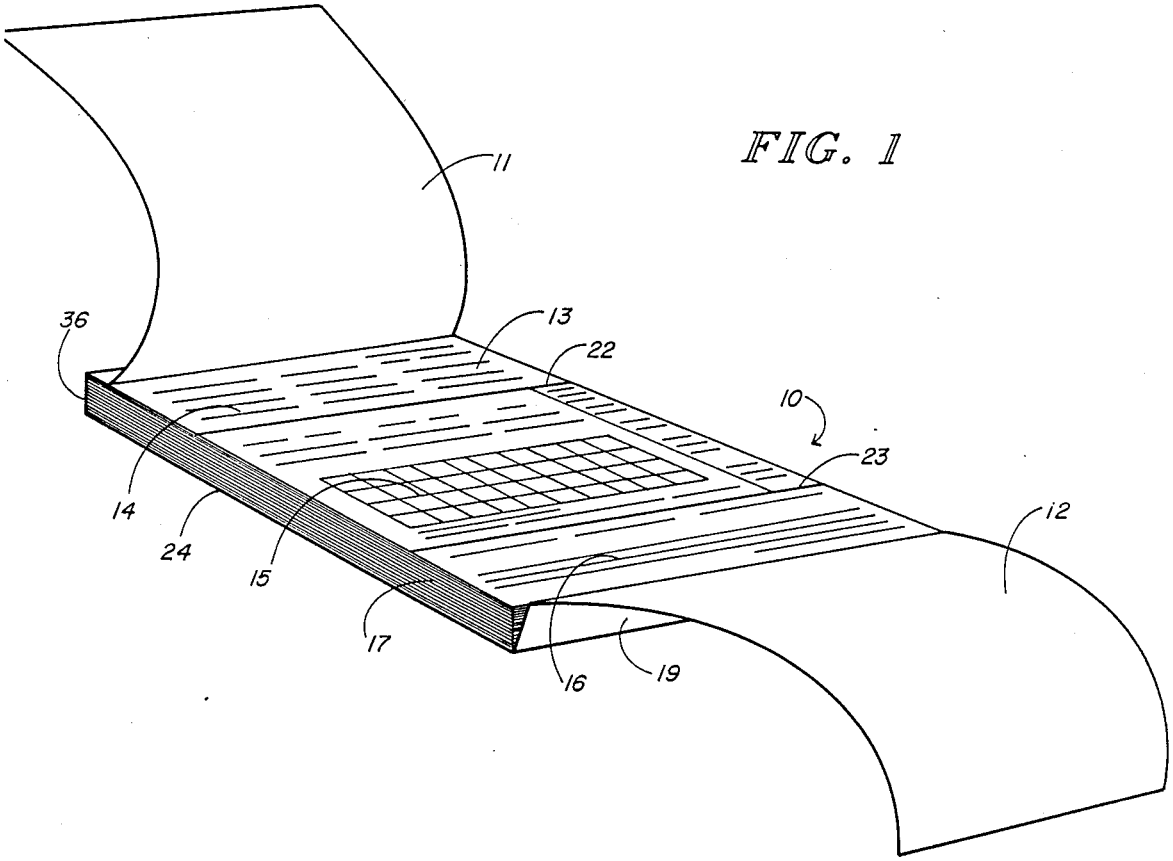
FIG. 1 is a perspective view of the driver's recording system and apparatus in which the printed material is shown in representative fashion by a number of lines.

The Driver's Recording System and Apparatus of the instant invention is depicted generally in FIG. 1 at numeral 10. As can be seen by reference to FIG. 1, the invention 10 provides a number of printed pages 17 which are enclosed in a wrap-around cover 24. The wrap-around cover 24 includes a outer cover sheet 11 of a material having some stiffness such as card stock or the like. The inner cover sheet 12 of the wrap-around cover 24 is provided to be inserted between the sets of printed sheets 17 so that the impression made by a writing instrument such as a pen or pencil will not record on subsequent sheets. Printed sheets 17 are made of carbonless paper which provide an impression on subsequent sheets without the use of carbon paper.

On the printed sheets 17, it can be seen from reference to FIG. 1 that the printed sheet 15 is divided into three separate portions: an upper driver's expense portion 13, a middle driver's record of duty status 14, and a lower driver's daily vehicle inspection report 16. Prescored or perforated on each printed sheet 15 are lines 22 and 23 to separate the three sections 13, 14, and 16 into their respective parts.

Figure 2:
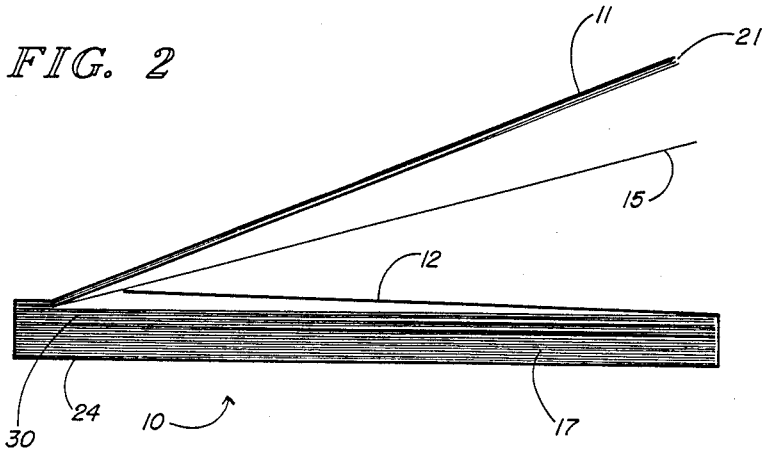
FIG. 2 is a side elevational view of the driver's recording system and apparatus in accordance with the present invention.
Figure 4:
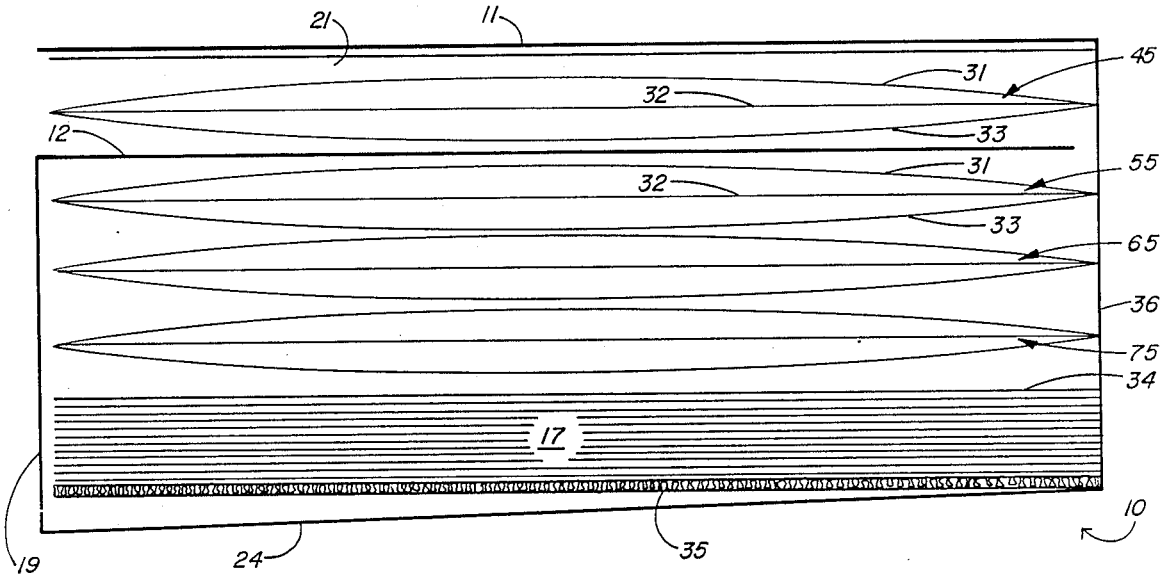
FIG. 4 is a side diagrammatic elevational view in representative fashion of the present invention depicting the arrangement and sequence of the log pages, cover, backing, and advertising space.

As can be seen by careful reference to FIGS. 1, 2 and 4, wraparound cover sheet 24 provides an outer cover 11 and inner cover 12 which both have space available for advertising to be printed thereon. Cover sheet 24 is bound to the spline only, and is not attached at front edge 19. With reference to FIG. 2, it is contemplated that additional sheets 21 can be provided under cover sheet 11 to provide additional advertising space as needed without interfering with the use of the apparatus 10.

Figure 3:
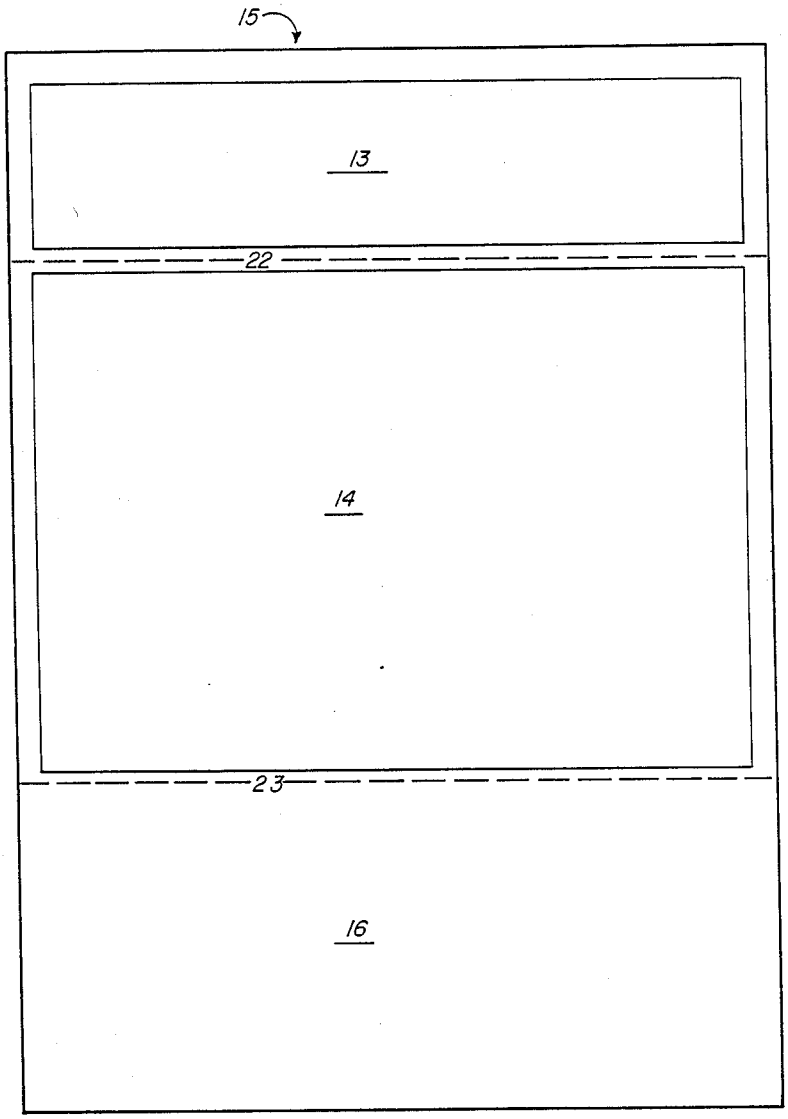
FIG. 3 is a front plan view of one of the log pages showing the three sections of the driver's expenses, the driver's record of duty status, and the driver's daily vehicle inspection report and separations therebetween, all in accordance with the present invention.

With reference to FIG. 3, it can be shown that the printed portion 15 of the invention 10 includes three sections: driver's personal expenses 13, driver's record of duty status 14, and driver's daily vehicle inspection report 16. Those three sections 13, 14, and 16 are divided by prescored easily separated score lines 22 and 23 which allow the user to separate the three sections 13, 14, and 16 from each other by grasping and pulling them apart.

With reference to FIG. 4 where it can be seen that wrap-around cover 24 is shown in place with outer top cover 11 having an additional advertising sheet 21 and inner cover 12. Inner cover 12 is placed underneath printed set 45 which includes a top original sheet 31, middle duplicate sheet 32, and lower driver's copy sheet 33. Set 45 is made of carbonless paper; that is, no carbon is required to make an impression from one sheet to another. When the driver wishes to record on set 45, which would be the needed set for a single day, he simply inserts inner lower cover 12 between set 45 and the subsequent set 55 as depicted in FIG. 4. By so inserting inner cover 12, he would not record below to set 55 or lower when writing on set 45. As is shown in FIG. 4, sets 45, 55, and 65 make up a complete driver's record for three days. Between every three sets 45, 55, and 65, an additional inner advertising sheet 34 is provided which contains additional advertising space to be brought to the attention of the driver. In the preferred embodiment, the apparatus 10 includes 31 sets of three printed log sheets as depicted in FIGS. 3 and 4 and includes one inner advertising sheet 34 between every three sets.

Wrap-around cover 24 is made of heavy card stock and contains advertising on all sides as it is only attached at upper end 36 as depicted in FIG. 1 and FIG. 4. Binding end 36 binds all sets of log sheets, lower stiffening board 35, and wrap-around cover 24 along with additional upper advertising sheets 21 and inner advertising sheets 34 to make a complete semi-rigid record. Lower stiffening board 35 is comprised of a stiff board or cardboard and could contain advertising; however, in the preferred embodiment, no advertising is provided on lower stiffening board 35.

The sizes of the sheets of paper, card stock, and cardboard as utilized in the driver's recording system and apparatus 10 could vary substantially while still remaining within the scope of the invention. However, in the preferred embodiment the log sheets are $8\frac{1}{2}'' \times 12''$ and the wrap-around cover 24 is $8\frac{1}{2}'' \times 36''$ and is printed on both sides with advertising.

It is contemplated that the 31 sets of log sheets could be either a triple set as previously described or a double set in which there would be an original 31 and a driver's copy 33 and not a third duplicate sheet 32. The duplicate sheet 32, it is contemplated, in a set of three would be for the records of the driver's employer.

Although specific applications, materials, components, sequences of events, and methods have been stated in the above description of the preferred embodiment of the invention, other suitable materials, other applications, components, and process steps as listed herein may be used with satisfactory results and varying degrees of quality.

In addition, it will be understood that various other changes in details, materials, steps, arrangements of parts and uses which have been herein described and illustrated in order to explain the nature of the invention will occur to and may be made by those skilled in the art, upon a reading of this disclosure, and such changes are intended to be included within the principles and scope of this invention as hereinafter claimed.

We claim:

1. A Driver's Recording System and Apparatus comprising:

a plurality of sets of carbonless paper printed sheets each sheet having an upper edge and a lower edge and having space for recording the driver's record of duty status, driver's daily vehicle inspection report, and driver's expenses thereon;

an outer cover bound to the upper edge of said printed sheets, said cover having space for advertising thereon; and a stiffening sheet having an upper edge wherein said printed sheet's upper edge and said stiffening sheet's upper edge are bound to said outer cover between said outer cover and said printed sheets.

2. The Driver's Recording System and Apparatus as described in claim 1 further comprising at least one inner advertising sheet having an upper edge and attached to said outer cover.

3. The Driver's Recording System and Apparatus as described in claim 2 wherein said advertising sheet is between said printed sheets and said outer cover.

4. The Driver's Recording System and Apparatus as described in claim 1 wherein said printed sheets are perforated so as to be separable into the multiple parts of drivers record of duty status, drivers daily vehicle inspection report and drivers expenses.

5. The Driver's Recording System and Apparatus as described in claim 1 wherein said outer cover is comprised of a single sheet folded to provide a top cover, a back, a binding area, and an inner cover.

6. The Driver's Recording System and Apparatus as described in claim 1 wherein said printed sheets have a lower edge and wherein every three of said sheets are joined at said lower edge and said upper edge to provide a set of sheets.

7. The Driver's Recording System and Apparatus as described in claim 1 wherein said printed sheets have a lower edge and wherein every two of said sheets are joined at said lower edge and said upper edge to provide a set of sheets.

8. A process for recording a truck driver's duty status, vehicle inspection, and expenses comprising the steps of:

providing a plurality of sets of carbonless paper printed sheets each sheet having an upper edge and a lower edge and having space for recording the driver's record of duty status, driver's daily vehicle inspection report, and driver's expenses thereon; an outer cover attached to the upper edge of said printed sheets, said cover having space for advertising thereon; and a stiffening sheet having an upper edge wherein said printed sheet's upper edge and said stiffening sheet's upper edge are bound to said outer cover between said outer cover and said printed sheets; and recording the expenses, duty status, and vehicle inspection on said sheets.

* * * * *